US010299555B1

(12) United States Patent
Yu

(10) Patent No.: US 10,299,555 B1
(45) Date of Patent: May 28, 2019

(54) LUGGAGE COVER

(71) Applicant: Travelers Club Luggage, Inc., La Palma, CA (US)

(72) Inventor: Peter Yu, La Palma, CA (US)

(73) Assignee: Travelers Club Luggage, Inc., La Palma, CA (US)

( * ) Notice: Subject to any disclaimer, the term of this patent is extended or adjusted under 35 U.S.C. 154(b) by 0 days.

(21) Appl. No.: 15/951,881

(22) Filed: Apr. 12, 2018

(51) Int. Cl.
*A45C 13/00* (2006.01)
*A45C 5/14* (2006.01)

(52) U.S. Cl.
CPC ..... *A45C 13/002* (2013.01); *A45C 5/14* (2013.01)

(58) Field of Classification Search
CPC ..... A45C 13/002; A45C 5/14; A45C 5/06; A45C 13/40; A45C 5/02
USPC ..... 150/154–167; 190/26, 19; 108/90
See application file for complete search history.

(56) References Cited

U.S. PATENT DOCUMENTS 7,077,251 B1 * 7/2006 Gaither ..... A45C 13/002 150/105
7,441,641 B2 10/2008 Beakey
D662,345 S * 6/2012 Cuenod ..... D6/611
9,427,058 B2 * 8/2016 Boglione ..... A45C 5/03
2006/0086444 A1 * 4/2006 Yu ..... A45C 13/002 150/154
2007/0017764 A1 * 1/2007 Cheng ..... A45C 13/002 190/100
2007/0204943 A1 * 9/2007 Beakey ..... A45C 13/002 150/154
2009/0154844 A1 * 6/2009 Greenberg ..... A45C 13/002 383/64
2010/0270115 A1 * 10/2010 Seamon ..... A45C 13/002 190/26
2011/0155526 A1 * 6/2011 Cheng ..... A45C 5/14 190/18 A
2014/0124107 A1 * 5/2014 Archer ..... A45C 13/002 150/154
2016/0107836 A1 * 4/2016 Kirby ..... B65F 1/14 150/154
2016/0360845 A1 * 12/2016 Somers ..... A45C 13/002
2017/0210512 A1 * 7/2017 Fulton ..... A45C 7/0077
2018/0192754 A1 * 7/2018 Teran ..... A45C 5/06

* cited by examiner

*Primary Examiner* — Fenn C Mathew
*Assistant Examiner* — Cynthia F Collado
(74) *Attorney, Agent, or Firm* — Lee, Hong, Degerman, Kang & Waimey

(57) ABSTRACT

A luggage cover includes a front panel; a back panel; a top panel coupled to the front panel and the back panel; a first side panel coupled to the front panel and the back panel; a second side panel coupled to the front panel and the back panel; a zipping mechanism formed along at least one of the first and second side panels and the top panel; and a plurality of flexible loops, wherein an opening is formed at an opposite side of the top panel to receive a luggage container.

11 Claims, 3 Drawing Sheets

LUGGAGE COVER

BACKGROUND OF THE INVENTION

Field

The present invention relates generally to a luggage cover. More specifically, the present invention relates to a luggage cover used for luggage containers with wheels.

Background

A challenge to traveling has always been carrying one's belongings in the most efficient and safe manner. In particular, frequent air travels make one's luggage wear and tear easily due to harsh handling of the luggage. Therefore, to avoid damage to the luggage, an easy and efficient way of protecting the luggage is necessary. To meet this challenge, luggage cover designs have appeared in the prior art for protection of luggage containers. However, prior art designs merely allow covering the luggage containers without providing a convenient way of accessing the luggage containers when it is necessary to open the luggage containers while the luggage containers are covered with the luggage cover. For example, see U.S. Pat. No. 7,441,641 B2.

According to prior art designs, with the cover on, a luggage container cannot be opened. That is, a conventional luggage cover must be taken off from the luggage container to allow opening of the luggage container. Moreover, the conventional luggage cover may not correspond to the size of the luggage container exactly, and the luggage cover may be loosely worn over the luggage container. Thus, the conventional luggage cover may be unintentionally taken off from the luggage container without any securing mechanisms.

Therefore, a solution is necessary to protect luggage containers more efficiently and securely without disrupting opening of the luggage container.

SUMMARY OF THE INVENTION

Accordingly, embodiments of the present invention are directed to an improved luggage apparatus that substantially obviates one or more of the problems due to limitations and disadvantages of the related art. According to one embodiment of the present invention, a luggage cover includes: a front panel; a back panel; a top panel coupled to the front panel and the back panel; a first side panel coupled to the front panel and the back panel; a second side panel coupled to the front panel and the back panel; a zipping mechanism formed along at least one of the first and second side panels and the top panel; and a plurality of flexible loops, wherein an opening is formed at an opposite side of the top panel to receive a luggage container.

According to an embodiment of the present invention, a luggage cover includes: a front panel; a back panel; a top panel coupled to the front panel and the back panel; a first side panel coupled to the front panel and the back panel; a second side panel coupled to the front panel and the back panel; a fastening mechanism configured to open and close the luggage cover; and a plurality of flexible loops, wherein an opening is formed at an opposite side of the top panel to receive a luggage container.

According to an embodiment of the present invention, a luggage system includes: a luggage container; a luggage cover sized to fit the luggage container, wherein the luggage cover includes: a front panel; a back panel; a top panel coupled to the front panel and the back panel; a first side panel coupled to the front panel and the back panel; a second side panel coupled to the front panel and the back panel; and a plurality of flexible loops shaped and configured to be coupled to wheels of the luggage container, wherein an opening is formed at an opposite side of the top panel to receive the luggage container.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings. Therefore, it is to be understood that both the foregoing general description and the following detailed description are exemplary and explanatory and are intended to provide a further explanation of the invention as claimed.

DETAILED DESCRIPTION OF EMBODIMENTS

Hereinafter, the present invention will be described with respect to the embodiment(s) illustrated in the annexed drawings.

Figure 1:
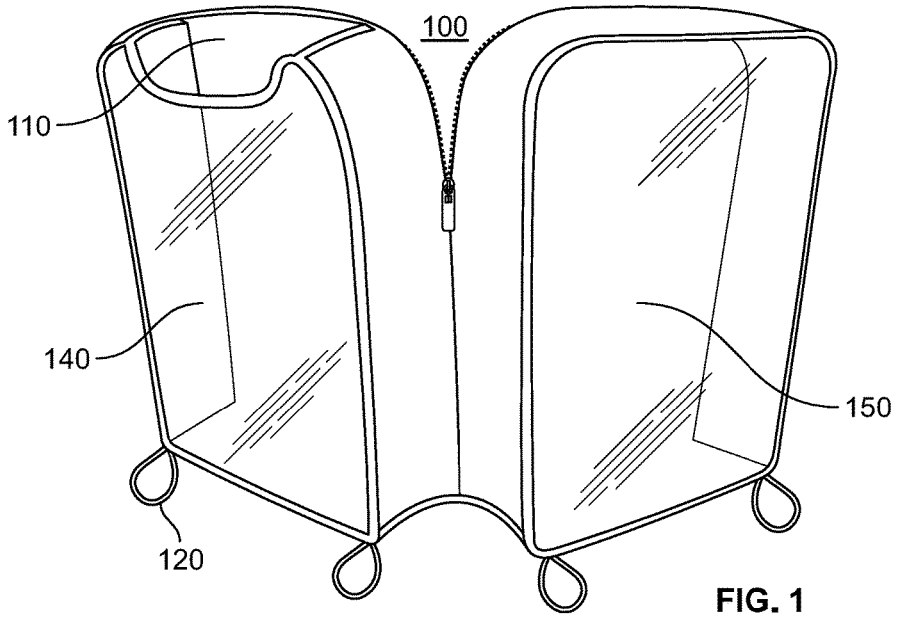
FIG. 1 is a view of a luggage cover in an open configuration according to an embodiment of the present invention.
Figure 2A:
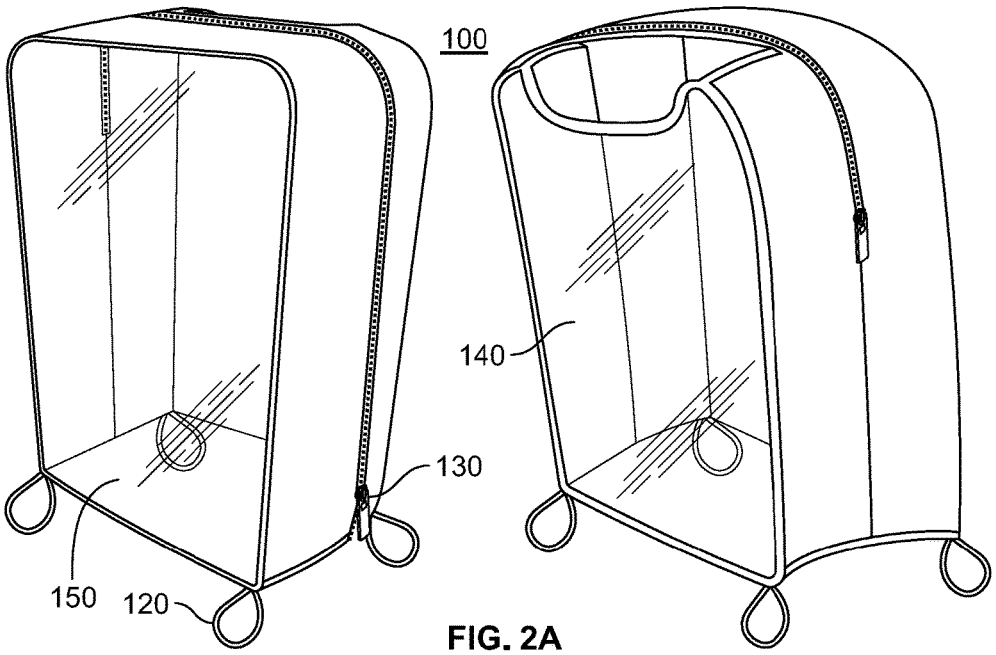
FIG. 2A includes front and rear perspective views of a luggage cover in a closed configuration according to an embodiment of the present invention.
Figure 2B:
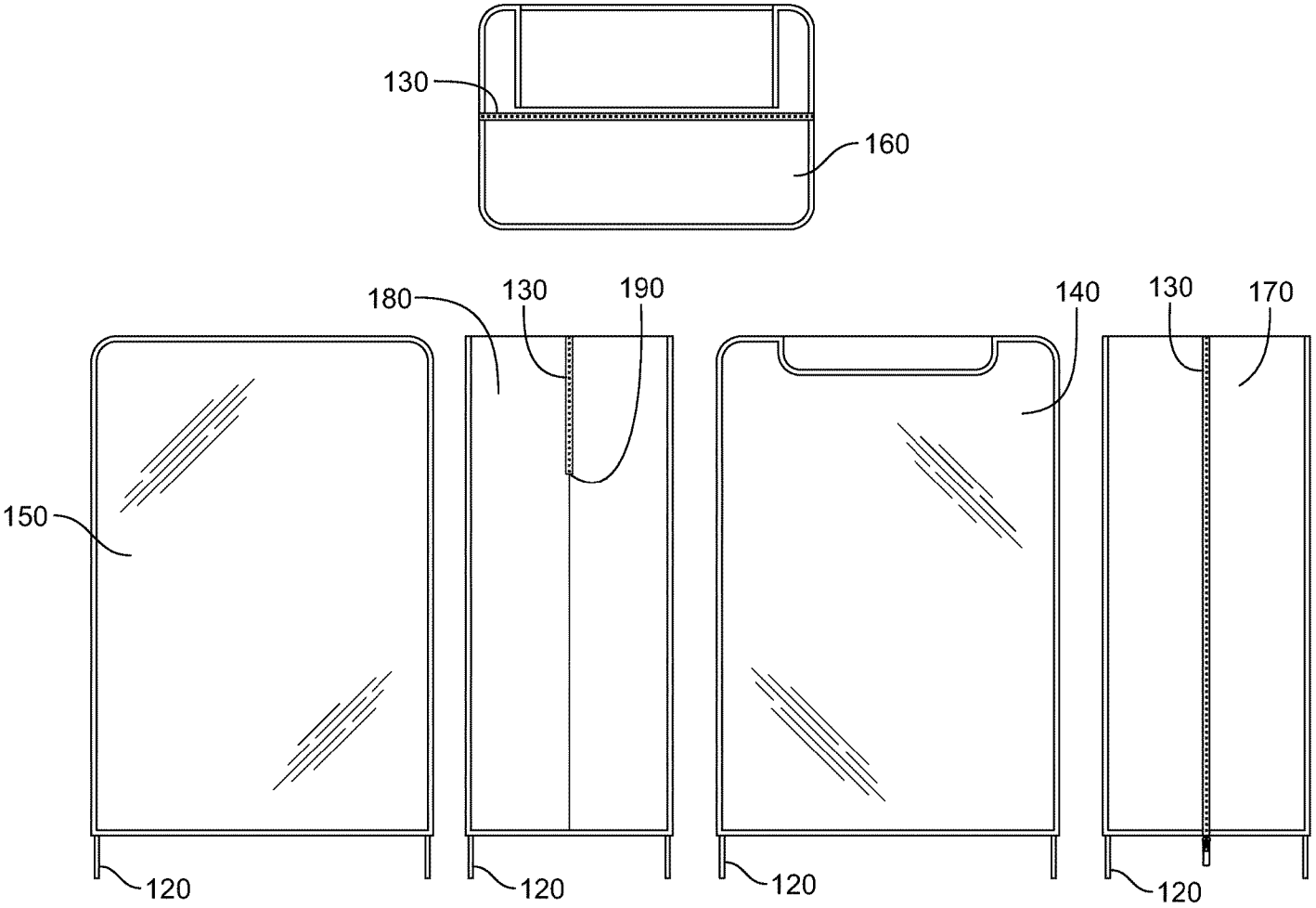
FIG. 2B includes plan views of top, first side, second side, front, and back panels of a luggage cover in a closed configuration according to an embodiment of the present invention.
Figure 3:
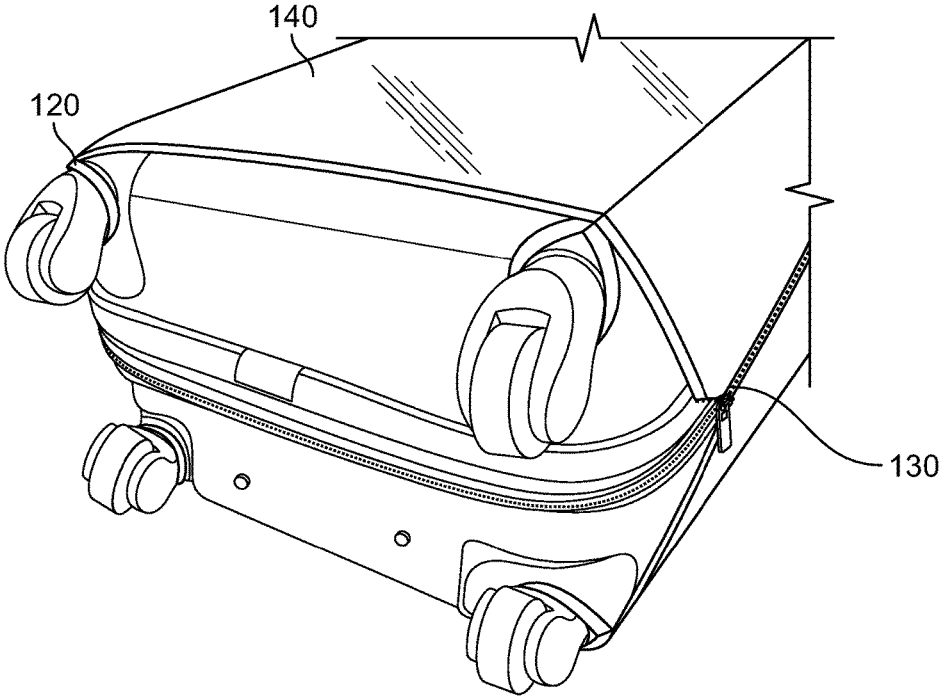
FIG. 3 is a bottom perspective view of a luggage cover according to an embodiment of the present invention, the luggage cover put on a luggage container.

Referring to FIGS. 1-3, a luggage cover according to an embodiment of the present invention is described. In FIG. 1, the luggage cover 100 is in an open configuration. The luggage cover 100 has a front panel 150 and a back panel 140 that are connected via side panels. For example, each of the side panels is secured to edges of the front and back panels 150, 140 to form a seam. Preferably, seam encompasses the majority of the perimeter of each of the side panels. For example, the seam may be formed by sewing or welding the respective panels together.

According to an embodiment of the present invention, an opening 110 is formed at the back panel 140 to allow passage of a telescopic handle of a luggage container when the luggage container is covered with the luggage cover 100. In one embodiment of the present invention, the luggage cover 100 is made of transparent or translucent material such that a luggage container covered with the luggage cover 100 is visible through the luggage cover 100. For example, at least the front and back panels 150, 140 may be made of the transparent or translucent material such as plastic or polyethylene. Further, the material used for the luggage cover 100 is preferably a waterproof or water-resistant material.

The luggage cover 100 also has four elastic loops 120, each of the four elastic loops 120 is used to enclose a corresponding one of four wheel attachments coupled to the luggage container. The elastic loop 120 will be discussed further with reference to FIG. 3.

In FIGS. 2A and 2B, the luggage cover 100 is in a closed configuration. The luggage cover 100 in the open configuration is closed by a zipper 130 formed along at least one side panel 170/180 and a top panel 160 of the luggage cover 100. For example, a bottom stop 190 of the zipping mechanism is formed at an upper portion of the second side panel 180, a slider of the zipping mechanism starting from the bottom stop, moving along the tracks and ending at a bottom end portion of the first side panel 170 to close the luggage cover 100 completely. In an alternative embodiment, any other coupling/fastening mechanisms may be used instead of the zipper 130 to close/open the luggage cover 100. For example, a hook and loop fastener or hook and ring-type coupling system may be used as a coupling/fastening mechanism. Once the front panel 150, back panel 140, and the side panels 170, 180 are secured together by the zipper 130, the bottom of the luggage cover 100 forms an opening, enabling a user to slide the luggage cover 100 over a luggage container to cover most surface areas of the luggage container.

However, the luggage cover 100 may be put on a luggage container while the luggage cover 100 is in the open or closed configuration. Depending on a size of the luggage container, sometimes it may be easier to put the luggage cover 100 over the luggage container while the luggage cover 100 is in the open configuration, for example, when the luggage cover 100 is too tight for the size of the luggage container, such that the luggage cover 100 is closed by the zipper 130 after the luggage container is covered by the luggage cover 100 first.

The luggage cover 100 may be manufactured in various sizes to accommodate various sizes of luggage containers. The luggage cover 100 may also be manufactured in a variety of shapes to accommodate luggage containers of various shapes. For example, the luggage cover 100 may be generally sized to cover a standard carry-on sized luggage container.

In one embodiment of the present invention, at least a portion of the luggage cover 100 is made of elastic material to more easily and flexibly accommodate the luggage container because sizes of luggage containers may vary even if the luggage containers are sold as carry-on sized luggage. For example, at least the side panels 170, 180 and top panel 160 formed between the front and back panels 140, 150 may be made of flexible material, such as spandex fibers or similar materials, such that areas of the top and side panels may be expanded based on a size of the luggage container. In one embodiment of the present invention, the zipper 130 is formed along substantially center lines of at least one of the expandable side panel and the expandable top panel. For example, as shown in FIG. 2B, zipper tracks are formed along a portion of a first side panel 170, the top panel 160, and a second side panel 180.

FIG. 3 shows the luggage cover 100 put on a luggage container. In particular, a bottom portion of the luggage container, to which wheels are coupled, is shown in FIG. 3. When the luggage container is covered with the luggage cover 100, the flexible loops 120 can be easily coupled to the wheels of the luggage container to secure the luggage cover 100 on the luggage container. Since the loop 120 is made of a flexible material, the wheel of the luggage container can be easily secured through the loop 120 regardless of a size of the wheel.

Once the wheels of the luggage container are secured by the flexible loops 120, the luggage cover 100 stays on the luggage container even if the luggage cover 100 covering the luggage container is open by the zipper 130. This feature allows opening and closing of the luggage container without taking the luggage cover 100 off from the luggage container contrary to the conventional luggage covers that require removing the luggage covers from luggage containers first to access the luggage containers. Therefore, it is very cumbersome to open a luggage container covered with a conventional luggage cover. In contrast, it is very easy to open the luggage container even if the luggage container is covered with the luggage cover 100 because of the zipper 130 allowing opening of the luggage cover 100 and the flexible loops 120 securely fixed to the wheels of the luggage container.

Those skilled in the art will appreciate that alternative embodiments exist from the above description of the embodiments without departing from the spirit and scope of the invention. In addition, luggage cover may be made with any material that is suitable. The luggage cover described herein may be of any sizes and for example, the luggage cover is usable for luggage containers including wheeled or non-wheeled luggage, soft or hard side luggage, a trunk, a suitcase, a garment bag, a tote, a duffle back, a backpack, and any types of bags.

Therefore, the foregoing description of the preferred embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto. The above specification and examples provide a complete description of the manufacture and use of the composition of the invention. Since many embodiments of the invention can be made without departing from the spirit and scope of the invention, the invention resides in the claims hereinafter appended.

What is claimed is:

1. A luggage cover comprising:

a front panel;

a back panel;

a top panel coupled to the front panel and the back panel;

a first side panel coupled to the front panel and the back panel;

a second side panel coupled to the front panel and the back panel;

a zipping mechanism formed along at least one of the first and second side panels and the top panel; and a plurality of flexible loops, wherein an opening is formed at an opposite side of the top panel to receive a luggage container, wherein tracks of the zipping mechanism are formed along the first side panel, the top panel, and the second side panel, and wherein a bottom stop of the zipping mechanism is formed at an upper portion of the second side panel, a slider of the zipping mechanism starting from the bottom stop, moving along the tracks and ending at a bottom end portion of the first side panel to close the luggage cover completely.

2. The luggage cover of claim 1, wherein at least one of the front panel or back panel is transparent or translucent.

3. The luggage cover of claim 1, wherein each of the plurality of loops is configured to be coupled to a corresponding wheel among a plurality of wheels of the received luggage container.

4. The luggage cover of claim 3, wherein the corresponding wheel is coupled to the loop by passing through the loop.

5. The luggage cover of claim 1, wherein a number of the plurality of loops is four.

6. The luggage cover of claim 1, wherein the plurality of loops are made of a flexible or expandable material.

7. The luggage cover of claim 1, wherein the luggage container is openable with the luggage cover coupled to the luggage container, opening of the luggage cover via the zipping mechanism allowing opening of the luggage container while the plurality of loops are coupled to wheels of the luggage container.

8. A luggage cover comprising:

a front panel;

a back panel;

a top panel coupled to the front panel and the back panel;

a first side panel coupled to the front panel and the back panel;

a second side panel coupled to the front panel and the back panel;

a fastening mechanism configured to open and close the luggage cover; and a plurality of flexible loops, wherein an opening is formed at an opposite side of the top panel to receive a luggage container, and wherein the fastening mechanism is formed along substantially center lines of at least one of the first and second side panels and the top panel such that:

each of the at least one of the first and second side panels and the top panel is separated into two portions when the luggage cover is in an open configuration; and the two portions are combined to form the at least one of the first and second side panels and the top panel when the luggage cover is in a closed configuration.

9. The luggage cover of claim 8, wherein at least the top panel, the first side panel, and the second side panel are made of a flexible material such that the luggage cover is expandable according to a size of the received luggage container.

10. The luggage cover of claim 8, wherein the plurality of flexible loops are shaped and configured to receive wheels of the luggage container, the plurality of loops allowing secure covering of the received luggage container by being coupled to the wheels.

11. A luggage system comprising:

a luggage container;

a luggage cover sized to fit the luggage container, wherein the luggage cover comprises:

a front panel;

a back panel;

a top panel coupled to the front panel and the back panel;

a first side panel coupled to the front panel and the back panel;

a second side panel coupled to the front panel and the back panel;

a zipping mechanism formed along at least one of the first and second side panels and the top panel, the zipping mechanism allowing opening and closing of the luggage cover; and a plurality of flexible loops shaped and configured to be coupled to wheels of the luggage container, wherein an opening is formed at an opposite side of the top panel to receive the luggage container, wherein tracks of the zipping mechanism are formed along the first side panel, the top panel, and the second side panel, and wherein a bottom stop of the zipping mechanism is formed at an upper portion of the second side panel, a slider of the zipping mechanism starting from the bottom stop, moving along the tracks and ending at a bottom end portion of the first side panel to close the luggage cover completely.

* * * * *